US008905570B2

(12) United States Patent
Hartman

(10) Patent No.: US 8,905,570 B2
(45) Date of Patent: Dec. 9, 2014

(54) LIGHTING ASSEMBLY AND ILLUMINATED DECKING

(75) Inventor: Michael S. Hartman, Sinking Spring, PA (US)

(73) Assignee: Michael S. Hartman, Sinking Spring, PA (US)

( * ) Notice: Subject to any disclaimer, the term of this patent is extended or adjusted under 35 U.S.C. 154(b) by 68 days.

(21) Appl. No.: 13/405,894

(22) Filed: Feb. 27, 2012

(65) Prior Publication Data

US 2012/0236547 A1 Sep. 20, 2012

Related U.S. Application Data

(60) Provisional application No. 61/446,598, filed on Feb. 25, 2011.

(51) Int. Cl.

| | |
|---|---|
| ***F21S 8/00*** | (2006.01) |
| ***F21V 33/00*** | (2006.01) |
| ***B66B 23/22*** | (2006.01) |
| *F21Y 101/02* | (2006.01) |
| *F21W 111/08* | (2006.01) |
| *E04F 11/18* | (2006.01) |

(52) U.S. Cl.

CPC ..... *B66B 23/225* (2013.01); *F21Y 2101/02* (2013.01); *F21W 2111/08* (2013.01); *F21V 33/006* (2013.01); *E04F 2011/1872* (2013.01)

USPC ..... 362/152; 362/249.002; 362/235

(58) Field of Classification Search

USPC ..... 362/152, 249.02, 235

See application file for complete search history.

(56) References Cited

U.S. PATENT DOCUMENTS

| | | | | |
|---|---|---|---|---|
| 5,222,799 | A * | 6/1993 | Sears et al. | 362/146 |
| 7,245,279 | B2 * | 7/2007 | Wang | 345/84 |
| 2005/0141225 | A1 * | 6/2005 | Striebel | 362/382 |
| 2005/0243576 | A1 * | 11/2005 | Park et al. | 362/612 |
| 2011/0019416 | A1 * | 1/2011 | Poissonnet et al. | 362/249.02 |
| 2011/0038154 | A1 * | 2/2011 | Chakravarty et al. | 362/249.02 |
| 2012/0113633 | A1 * | 5/2012 | Bowen | 362/235 |

* cited by examiner

*Primary Examiner* — Evan Dzierzynski

(74) *Attorney, Agent, or Firm* — Fox Rothschild LLP

(57) ABSTRACT

A lighting assembly for illuminating a deck area having a longitudinally extending base plate having a front side and a back side, a lamp having at least one LED and a circuit board, and a heat sink connected to said circuit board. The lighting assembly and the electrical wire can be hidden from view, providing a more aesthetically pleasing appearance. Furthermore, the lighting system can be installed simultaneously with the deck itself, or afterwards.

11 Claims, 5 Drawing Sheets

FIG.5
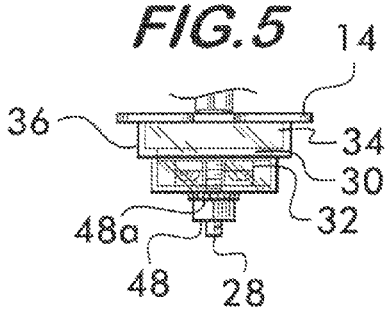
FIG.6
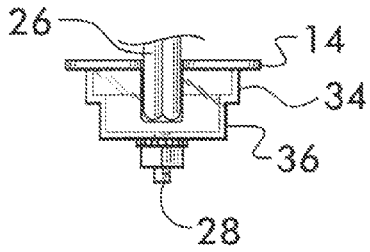
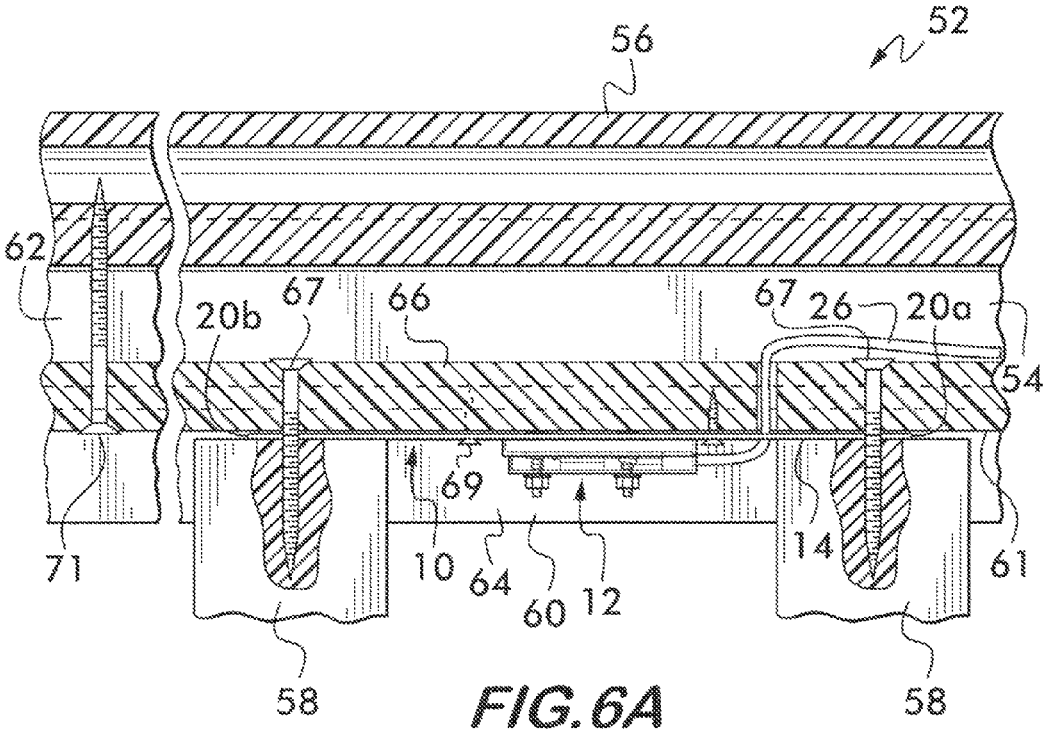
FIG.6A

FIG.8
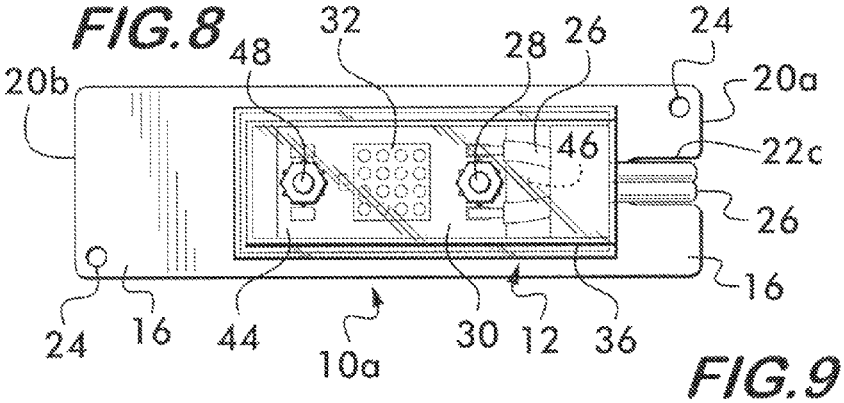
FIG.9
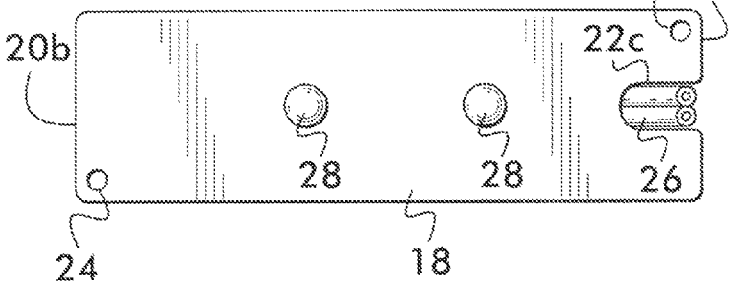
FIG.10
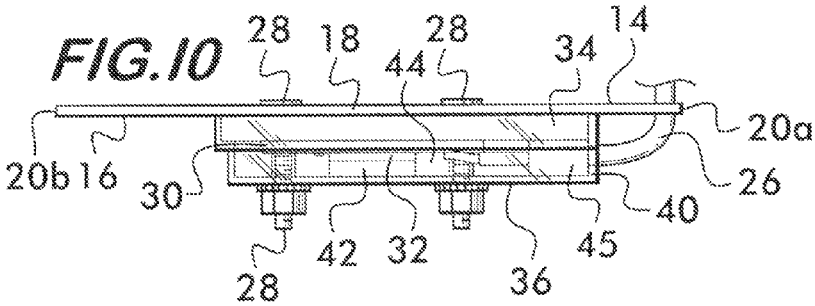
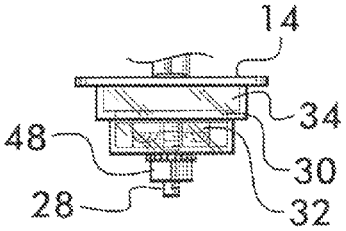
FIG.11
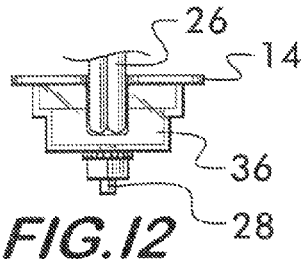
FIG.12

LIGHTING ASSEMBLY AND ILLUMINATED DECKING

CROSS-REFERENCE TO RELATED APPLICATIONS

This application claims the benefit of U.S. Provisional Application No. 61/446,598, filed Feb. 25, 2011, and which is hereby incorporated herein by reference. This application also is related to U.S. Design application 29/406,698, filed Nov. 17, 2011, which is hereby incorporated herein by reference.

FIELD OF THE INVENTION

This invention relates to a lighting assembly for illuminating decking structures.

BACKGROUND OF THE INVENTION

Outdoor deck areas are popular with residential home owners. They add beauty to the home, provide a functional place to enjoy the outdoors, and add value to the residence. Decks require sufficient lighting to be enjoyed during night time, for safety reasons to prevent injuries, e.g., near railings and stairs, and for security.

Current lighting systems may require wiring on the surface of the posts, railings, and/or deck surfaces, which is not aesthetically pleasing. The wires can be hidden within a conduit, but this is still not aesthetically pleasing.

Accordingly, it is desirable to provide a light assembly for decks useable with traditional and modern deck materials and construction, which is easy to install, safe to use, energy efficient, and which is aesthetically pleasing.

SUMMARY OF THE INVENTION

In broad terms, the invention provides a light fixture for use with a deck rail that includes a longitudinally extending base plate having a front side and a back side, a lamp having at least one LED and a circuit board, and a heat sink connected to the circuit board.

As another embodiment, the invention provides a deck rail and light assembly combination that includes a deck rail, at least two of balusters attached to an underside of said deck rail, and a light assembly attachable to said underside of the deck rail between the balusters, the light assembly having a longitudinally extending base plate having a front side and a back side and a lamp having at least one LED and a circuit board.

BRIEF DESCRIPTION OF THE DRAWINGS

The following detailed description will be better understood when read in conjunction with the figures appended hereto. For the purpose of illustrating the invention, there is shown in the drawings a preferred embodiment. It is understood, however, that this invention is not limited to this embodiment or the precise arrangements shown.

FIG. 5 is an end view of the lamp portion of the lighting assembly taken from the left side in FIG. 1;

FIG. 6 is an end view of the lamp portion of the lighting assembly taken from the right side in FIG. 1;

FIG. 6A is a cross-sectional view taken along line 6A-6A in FIG. 1;

FIG. 8 is a top view of the lighting assembly shown in FIG. 7 isolated from the handrail;

FIG. 9 is a bottom view of the lighting assembly shown in FIG. 8;

FIG. 10 is a side view of the lighting assembly shown in FIG. 8;

FIG. 11 is an end view of the lamp portion of the lighting assembly taken from the left side in FIG. 8; and FIG. 12 is an end view of the lamp portion of the lighting assembly taken from the right side in FIG. 8.

DETAILED DESCRIPTION OF THE EMBODIMENTS

Exemplary embodiments of the present invention are now described with reference to the Figures described herein. A first embodiment of the invention is described first with reference to FIGS. 1-6, showing a light fixture by itself and in combination with an exemplary hand rail; a second embodiment is then described with reference to FIGS. 7-12.

Figure 1:
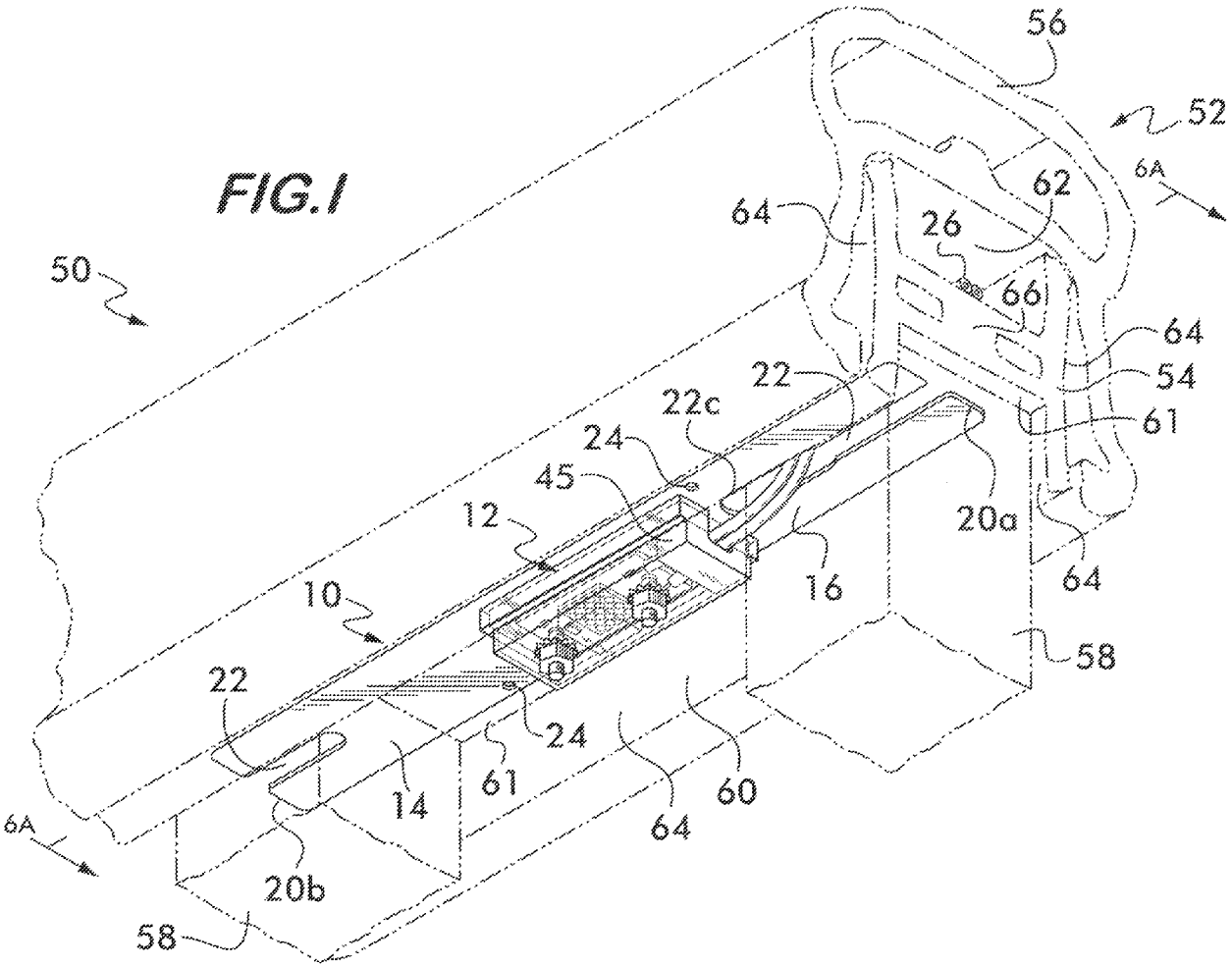
FIG. 1 is a perspective view of a light assembly mounted on a handrail in accordance with the present invention.
Figure 2:
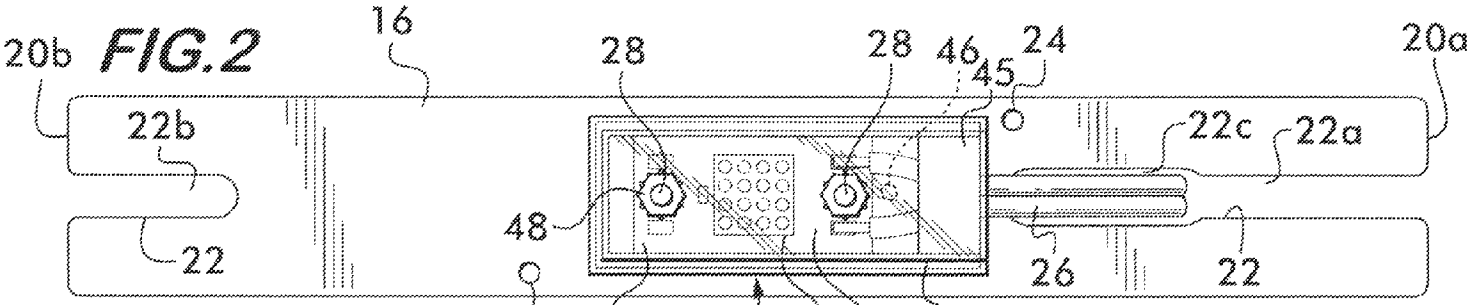
FIG. 2 is a top view of the lighting assembly shown in FIG. 1 isolated from the handrail.
Figure 3:
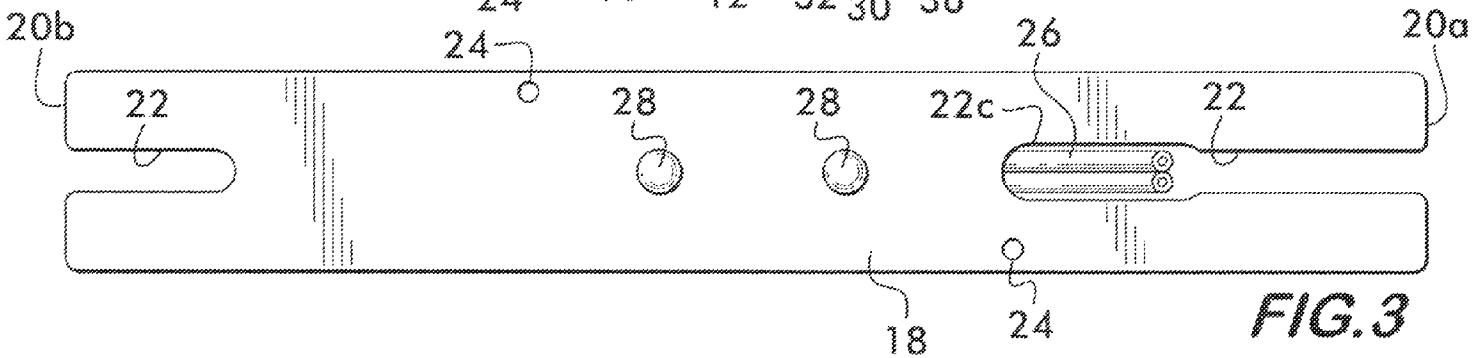
FIG. 3 is a bottom view of the lighting assembly shown in FIG. 2.

With reference to FIGS. 1 through 6, the light assembly 10 includes a lamp 12 fixed to a base or mounting plate 14. The base plate 14 is preferably rectangular extending in a longitudinal direction, and having a top face 16, bottom face 18, and longitudinal ends 20*a* and 20*b* as shown. The plate 14 is preferably made of any suitable material to withstand the outdoor environment, such as a stainless steel which also provides heat transfer benefits as further described below. It is configured and shaped to be mounted to deck components such as hand rails 50, having various slots 22 and openings 24 to facilitate mounting. The slot 22*a* on the right side in FIG. 2 is longer than the slot 22*b* on the left side and includes a wider portion 22*c* to accommodate an electrical wire 26 as shown. The length and width of the plate 14 is selected to work with decking components, the embodiment shown in FIG. 1 being preferred for use with hand rails having balusters spaced between about 2.5 inches to about 5 inches from one another and where the ends 20*a*, 20*b* of the plate 14 are secured between the balusters and the hand rail as further described below. Studs 28 affixed to and extending from the plate 14 are provided for attachment of the lamp 12.

The lamp 12 mounted to the plate 14 preferably includes a circuit board 30 having a light source 32 mounted thereon. In the preferred embodiment, the light source is an LED, here a single square array of 16 LEDs having parallel circuitry, 160 degree light distribution, and warm white 3000K 5.0 watt Xenon equivalent output. Other forms of LED's may be used, including a single larger LED. The electrical wire 26 is soldered to leads on the circuit board 30 for power. A low voltage lamp powered by a low voltage power supply (not shown) is preferred for safety.

The lamp 12 is mounted to a heat sink 34 using a thermal epoxy to ensure good heat transfer. In the preferred embodiment, the heat sink 34 is formed of a rectangular piece of metal such as nickel plated copper which is longer longitudinally than the circuit board 30 as shown, and which may contact the base plate 14 for heat transfer thereto. Any suitable material that provides good heat transfer can be used.

Figure 4:
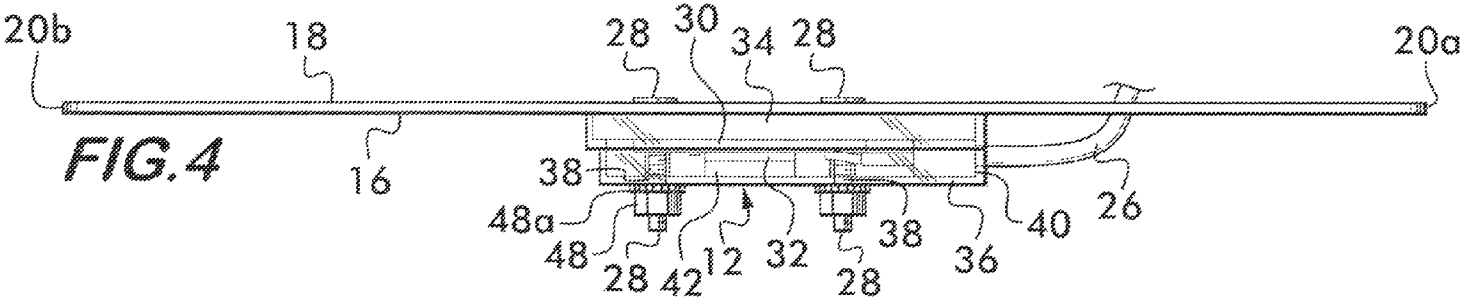
FIG. 4 is a side view of the lighting assembly shown in FIG. 2.

A translucent cover 36 covers the light source 32, circuit board 30 and the heat sink 34 as shown to form a single unit that can be mounted on the plate 14. As seen in FIGS. 2 and 4, the cover 36 is shaped to fit over and snap onto the heat sink 34, and includes openings 38 for the studs 28 and an opening 40 for the wire 26. The cover can be made of any suitable translucent material such as a polymer, e.g., polycarbonate, acrylic, Plexiglas, etc. The cover 36 includes a translucent lens portion 42 positioned directly over the LED light source 32 and is thicker than the remaining portions of the cover 32, here by extending downwardly towards the LEDs so as to be close to the LED and thereby maximize the light transmitted out from the lamp 12 to dispense the light as desired.

An internal space between the cover 36, circuit board 30 and heat sink 34 is filled with a translucent potting material 44 such as a two part silicone or epoxy potting material that preferably remains soft or gel like. Prior to addition of the potting material 44, a seal material 45, such as a one part silicone sealant, is added around the wire 26 to seal the wire area and retain the potting material 44. This seals and protects the electrical components from the environment, and seals the openings 38, 40 for the studs 28 and wire 26. The potting material 44 is added through a opening 46 formed on the back side of the heat sink 34 and which is not covered by the circuit board 30. Some of the potting material 44 may need to be removed for placement of the studs 28.

The lamp 12, including the heat sink 34 and lens 36, is affixed as a unit to the mounting plate 14 via the studs 28 and locking nuts 48 with locking washer 48*a*. This forms the completed light assembly 10. The heat sink 34 preferably transfers heat to the steel mounting plate 14 to aid in the removal of heat from the LEDs. It is appreciated that the mounting plate 14 can be configured and shaped as desired for the particular use.

The light assembly 10 can be integrated and combined with decking components as now described. With reference to FIGS. 1 and 6A, a modern deck hand rail system 52 is shown having a rail 50 formed of a lower rail 54, a decorative upper rail 56 that fits over the lower rail 54, and balusters 58. The lower rail 54 has an H shaped cross section forming a bottom channel 60 having an underside 61, with a top channel 62 and sides 64 extending downwardly to form the bottom channel 60. The balusters 58 are secured within the lower channel 60 by screws 67 passing through a central portion 66 from the upper channel side 62 into the upper end of the balusters 56. The decorative upper rail 56 is secured to the lower rail 54 by screws 71 extending from the bottom channel side 60 of the central portion 66 of the lower rail 54 into the upper rail 56, thereby finishing the hand rail 50 and covering the screws and the upper channel.

As seen in FIGS. 1 and 6A, the light assembly 10 extends longitudinally within the lower channel 60 above and between two balusters 58 against the underside 61 of the lower rail 54. The ends 20*a*, 20*b* of the light assembly mounting plate 14 are clamped between the balusters 58 and lower rail 54, the screws 67 extending from the lower rail 54 (from the upper channel 62 side) into the balusters 58 through the slots 16 of the mounting plate 14. Thus, no separate attachment means is required to affix the light assembly 10 to the lower rail 54, although screws 69 can be used through openings 24 for such purposes if desired as illustrated in FIG. 6A. The electrical wire 26 for the light assembly 10 passes through the opening slot 22*c* in the plate 14, through a hole drilled through the central portion 66 of the lower rail 54 into the top channel 62 through which the wire 26 is run to a power source. It is seen that the lower channel 60 in which the lighting 10 assembly is mounted hides the light assembly 10 from view, and provides protection from direct contact and shielding from the weather, e.g., rain.

It is appreciated that the light assembly 10 in combination with the rail system 52 provides an effective light source that is simple to install and aesthetically pleasing. The light assembly 10 is mounted within the lower channel 60 of the lower rail 54 during installation of the rail system 52, i.e., when the lower rail 54 is attached to the balusters 58. Holes for the wire 26 can be readily drilled in the lower rail 54, and the wire 26 run in the upper channel 62. The hand rail 50 is completed by attachment of the finish upper rail 56 to the lower rail 54 with screws 71 which covers the wire 26 within.

A second embodiment of a lighting assembly and a second hand rail assembly is now described. With reference to FIGS. 7 through 12, a lighting assembly 10*a* is similar to the lighting assembly 10 described above, having similar elements identified by the same reference numbers. In this embodiment, the lighting assembly 10*a* is identical to the lighting assembly 10 described above with the exception that the plate 14 is shorter in longitudinal length and does not have slots 22 through which screws from the hand rail to the balusters can pass. As will be described below, the lighting assembly 10*a* is preferred for installation where it is not practical or desirable to sandwich the lighting assembly plate 14 between the balusters and the hand rail as described above.

Figure 7:
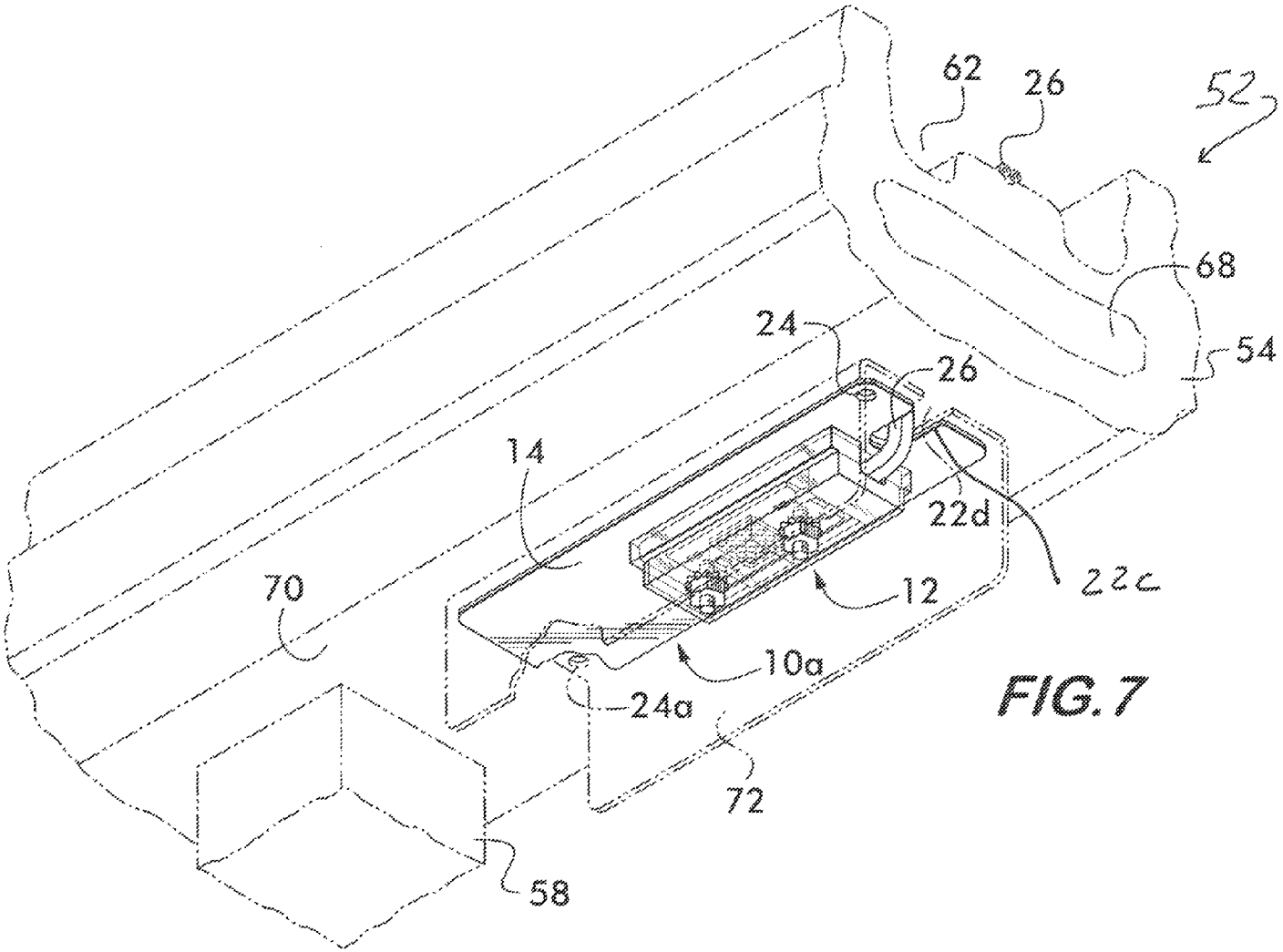
FIG. 7 is a view of another embodiment of a light assembly mounted on a handrail in accordance with the present invention.

An example of such an embodiment is now described with particular reference to FIG. 7 showing a different type of modern residential hand rail system 52 having a lower rail section 54 affixed to balusters 58 via screws as described above in reference to FIGS. 1 and 6A. The finish rail is not shown but fits over the lower rail 54 in a similar matter as in the embodiment described above.

The lower rail 54 is seen having a upper channel 62 and a middle channel 68, but not a lower channel as does the embodiment shown in FIG. 7. Thus, the lighting assembly 10*a* is affixed with screws 69 (see e.g., FIG. 6A) directly to an underside 70 of the lower rail 54 between the balusters 58 as shown (the baluster on the left side of the light assembly 10*a* being shown in FIG. 7, the baluster on the right of the light assembly 10*a* not shown). A shroud 72 can be provided to shield and protect the lighting assembly 10*a*, as well as hide the assembly from view and ensure that the light shines downward only. The shroud 72 has openings 24*a* that align with the openings 24 for receiving screws 69 (see e.g., FIG. 6A) and a slot 22*d* that aligns with slot 22*c* for the wire 26. Thus, it is seen that this embodiment is useable with rail assemblies that do not have a lower channel and for installation with previously installed rail systems. The wire 26 is run through an opening drilled through the underside 70 to the top channel 62 where it can be run to a power source before attaching or reattaching the finish upper rail (not shown). The wire hole will be drilled through the underside 70 to align with the slots 22*c* and 22*d*.

The shroud 72 has openings 24*a* corresponding with the openings 24 of the lighting assembly 10*a* for screws 69, and a slot 22*d* corresponding with the slot 22*c* of the plate 14 of the lighting assembly 10*a* for the wire 26. The shroud 72 is preferably made of any suitable material such as stainless steel, and can be colored as desired, e.g., via a polymer powdered coating. The shroud 72 is positioned between the underside 70 of the lower rail 54 and the light assembly 10, with screws in openings 24 of the light assembly 10*a* passing through the openings 24*a* in shroud 72 fixing both to the lower rail 54.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A deck rail and light assembly combination, comprising:

a deck rail;

at least two of balusters attached to an underside of said deck rail;

a light assembly attachable to said underside of said deck rail between said balusters, said light assembly comprising:

a longitudinally extending base plate having a front side and a back side; and a lamp unit including:

at least one LED and a circuit board;

a heat sink connected to said circuit board, and a translucent cover covering the at least one LED, circuit board and heat sink with the at least one LED and circuit board sealingly enclosed between the cover and the heat sink, wherein the lamp unit is mounted on said front face of said base plate with the heat sink in contact with the base plate.

2. A deck rail and light assembly combination in accordance with claim 1 further comprising a translucent potting material filling an internal space between the cover and the lamp so as to protect the lamp from the environment.

3. A deck rail and light assembly combination in accordance with claim 1 wherein the back side of said base plate is substantially flat.

4. A deck rail and light assembly combination in accordance with claim 1 further including an electrical wire connected to said lamp for providing power thereto, said wire sealingly extending through said cover to connect to said lamp, said base plate including a slot through which said wire passes.

5. A deck rail and light assembly combination in accordance with claim 1, further comprising:

a deck upper rail which is attachable to said deck rail (hereinafter the "deck lower rail") so as to be on top of said deck lower rail, there being a gap between said deck upper and lower rails when said upper rail is attached to said lower rail; and a wire providing power to said lamp, said wire extending through said deck lower rail to said gap to a power source.

6. A deck rail and light assembly combination in accordance with claim 5, wherein said base plate has longitudinal ends, at least one of which ends is fixed between the deck lower rail and one of said balusters.

7. A deck rail and light assembly combination in accordance with claim 6, wherein each of said longitudinal ends of said base plate are fixed between the deck lower rail and one of said balusters to fix said light assembly to said deck rail.

8. A deck rail and light assembly combination in accordance with claim 1, further comprising a shroud mounted to the underside of said deck rail between said balusters, said light fixture sitting within said shroud, said shroud having at least one side wall to conceal said light fixture.

9. A deck rail and light assembly combination in accordance with claim 1 further comprising a lens positioned over said LED.

10. A deck rail and light assembly combination in accordance with claim 9 further comprising a translucent cover covering the lamp.

11. A deck rail and light assembly combination in accordance with claim 10 wherein said lens is integrally formed with said cover.

* * * * *